US007127869B2

(12) United States Patent
Perry

(10) Patent No.: US 7,127,869 B2
(45) Date of Patent: Oct. 31, 2006

(54) WALL COVERING WITH IMPROVED CORNER MOLDING AND METHOD OF INSTALLATION

(75) Inventor: John E. Perry, Dania, FL (US)

(73) Assignee: Nailite International, Miami, FL (US)

( * ) Notice: Subject to any disclaimer, the term of this patent is extended or adjusted under 35 U.S.C. 154(b) by 0 days.

(21) Appl. No.: 10/164,262

(22) Filed: Jun. 5, 2002

(65) Prior Publication Data

US 2003/0226327 A1 Dec. 11, 2003

(51) Int. Cl.
*E04F 19/02* (2006.01)
*E04D 1/34* (2006.01)

(52) U.S. Cl. ..... 52/747.1; 52/288.1; 52/365; 52/520; 52/555

(58) Field of Classification Search ..... 52/288.1, 52/287.1, 314, 555, 365, 748.1, 747.1, 520, 52/535, 546

See application file for complete search history.

(56) References Cited

U.S. PATENT DOCUMENTS 3,123,185 A * 3/1964 Van der Rijst ..... 52/633
3,304,676 A * 2/1967 Sallie et al. ..... 52/276
3,651,610 A * 3/1972 Donahue ..... 52/278
3,826,054 A * 7/1974 Culpepper, Jr. ..... 52/309.8
5,076,037 A * 12/1991 Crick et al. ..... 52/520
5,247,784 A * 9/1993 Kitamura et al. ..... 56/10.8
5,249,402 A * 10/1993 Crick et al. ..... 52/533
5,347,784 A * 9/1994 Crick et al. ..... 52/520
5,400,555 A * 3/1995 Kantor ..... 52/169.7
5,537,792 A * 7/1996 Moliere ..... 52/531
5,542,222 A * 8/1996 Wilson et al. ..... 52/287.1
5,622,020 A * 4/1997 Wood ..... 52/546
5,634,314 A * 6/1997 Champagne ..... 52/712
5,651,227 A * 7/1997 Anderson ..... 52/520
5,813,179 A * 9/1998 Koenig et al. ..... 52/255
5,836,123 A * 11/1998 Gulino ..... 52/288.1
5,924,259 A * 7/1999 Marousek ..... 52/656.1
5,974,748 A * 11/1999 Sciuga et al. ..... 52/287.1

* cited by examiner

*Primary Examiner*—Robert Canfield
(74) *Attorney, Agent, or Firm*—Leydig, Voit & Mayer, Ltd.

(57) ABSTRACT

A wall covering and method of installation using corner moldings formed with a plurality of tiers of simulated building elements and a plurality of panels each formed with a plurality of rows of simulated building elements. The corner molding includes flanges along opposite sides formed with both (1) elongated fastener-receiving apertures for receiving fasteners which permit adjustable positioning and alignment of the tiers of building elements of the corner molding with rows of building elements of a panel to be mounted adjacent thereto and (2) circular apertures for receiving fasteners that precisely secure and retain the corner moldings in mounted position with the building elements of the corner molding and adjacent panel in predetermined aligned relation.

5 Claims, 3 Drawing Sheets

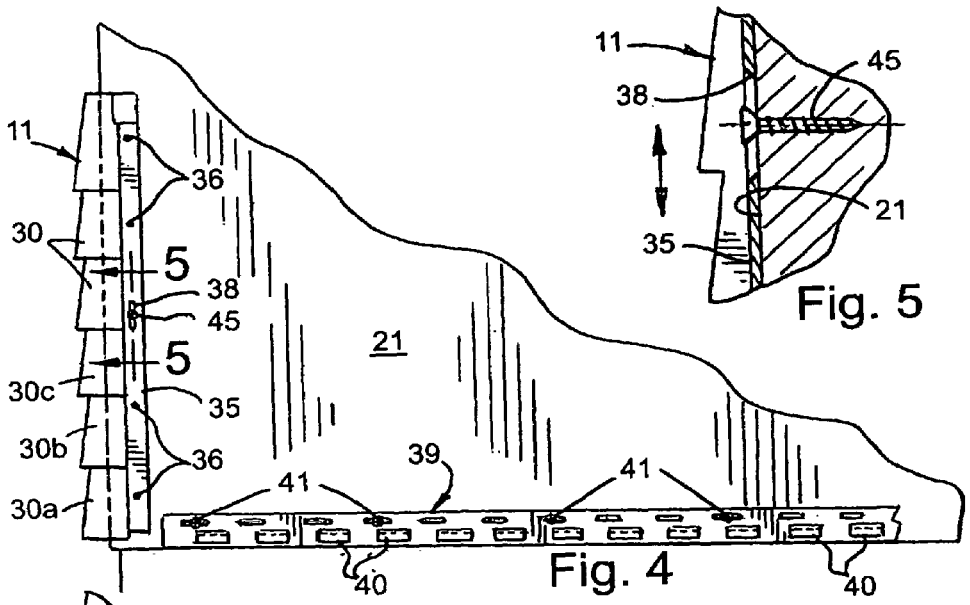
Fig. 4
Fig. 5
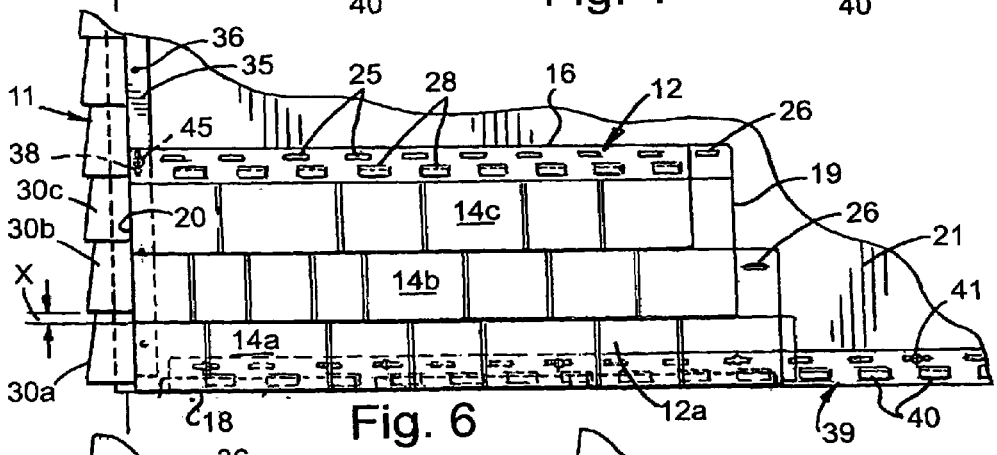
Fig. 6
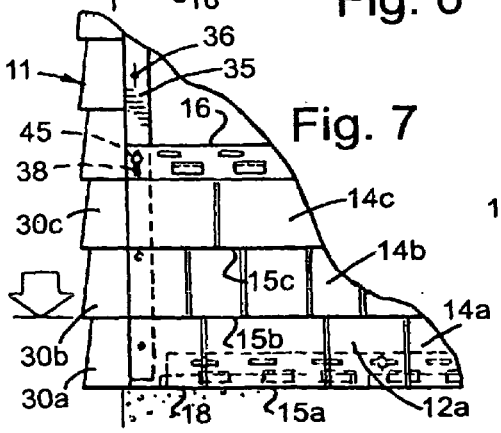
Fig. 7
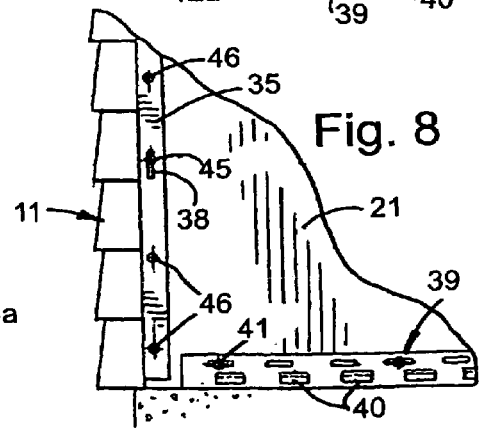
Fig. 8

WALL COVERING WITH IMPROVED CORNER MOLDING AND METHOD OF INSTALLATION

FIELD OF THE INVENTION

The present invention relates generally to roof and wall coverings primarily intended for outdoor usage, and more particularly, to roof and wall coverings comprised of relatively large panels which each are molded or otherwise formed with decorative patterns characteristic of conventional roofing and siding materials such as shake, tile, brick or the like.

BACKGROUND OF THE INVENTION

Various synthetic roof and wall coverings are known today, such as those formed of elongated thermoplastic panels that are nailed or screwed to a wall or roof support surface in horizontal courses or rows in partially overlapping relation to each other so as to provide a substantially water resistant, protective layer over the support surface. Such panels, which usually are identically molded, commonly are formed with a plurality of rows of simulated building elements, such as shake shingles. Since the panels are identically molded, a panel-to-panel identity can be easily noticed if the panels are not carefully installed. Because of the relatively large size of the panels, which usually have a length of 48 inches or more, they also are difficult to handle during installation. Installation problems particularly occur when installing such synthetic wall and roof coverings about a corner of the roof or sidewalls, and specifically, difficulties can be encountered in concealing the joints of panels at the corner.

In the installation of such synthetic panels about corners, it is common to use elongated corner moldings, each formed with a series of vertically arranged building elements corresponding to the building elements of the panels to be installed, which define 90° junctures with each other. Such corner moldings commonly have vertically extending mounting flanges adjacent opposite longitudinal sides with nail or screw-receiving apertures (i.e. fastener apertures) for securing the mounting flanges to respective angled support surfaces that define the corner. The abutting panels on opposite sides of the corner molding are mounted in overlying relation to the mounting flanges.

When starting a course of panels from a corner, the installer usually must hold the corner molding in one hand and the panel in the other hand, and at the same time attempt to align the building elements of the corner molding and panel and then secure the corner molding in place before mounting the panel. Because of the sizes of the corner molding and panel, this can be difficult, necessitating that the installer first preliminarily mount the corner molding, then arrange the abutting panel in its mounted position, then remove the mounting nails or screws from the corner molding, and readjust the position of the corner molding as necessary. Even then, it can be difficult to ensure proper alignment of the abutting simulated building elements of the corner molding and adjacent panel.

Similar installation problems occur in terminating a course of panels at a corner. The corner molding and the final panel of the course must either be simultaneously handled and aligned, or the corner molding preliminarily installed, the final panel preliminarily positioned in place, and then the corner molding reinstalled. Even slight skewing of the row, or misalignment of the building elements between the last panel and the corner molding, can significantly detract from the natural appearance of the wall covering. In such case, it is necessary for the installer to again remove the fastening nails or screws of the last panel and the corner molding, reposition the corner molding, and then remount the corner molding and panel. This is a tedious and time consuming procedure which can significantly impede the economic and efficient installation of the wall covering.

OBJECTS AND SUMMARY OF THE INVENTION

It is an object of the present invention to provide a synthetic wall and roof covering having corner moldings which facilitate more efficient and economical installation of the wall covering.

Another object is to provide a synthetic roof or wall covering as characterized above in which the corner moldings are adapted to more readily accommodate slight skewing or misalignment of the row of panels which join the corner molding.

A further object is to provide a corner molding for a synthetic wall or roof covering of the foregoing type which has mounting apertures that both accommodate adjustable installation of the corner molding on a corner while enabling precise securement of the corner molding when installed.

Other objects and advantages of the invention will become apparent upon reading the following detailed description and upon reference to the drawings, in which:

BRIEF DESCRIPTION OF THE DRAWINGS

FIGS. 4–9 are fragmentary plan views depicting installation steps according to the method of the present invention.

Figure 3:
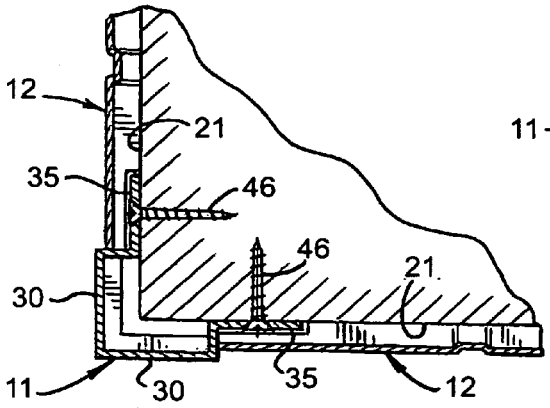
FIG. 3 is an enlarged fragmentary section of the corner of the wall covering shown in FIG. 2, taken in the plane of line 3—3.
Figure 1:
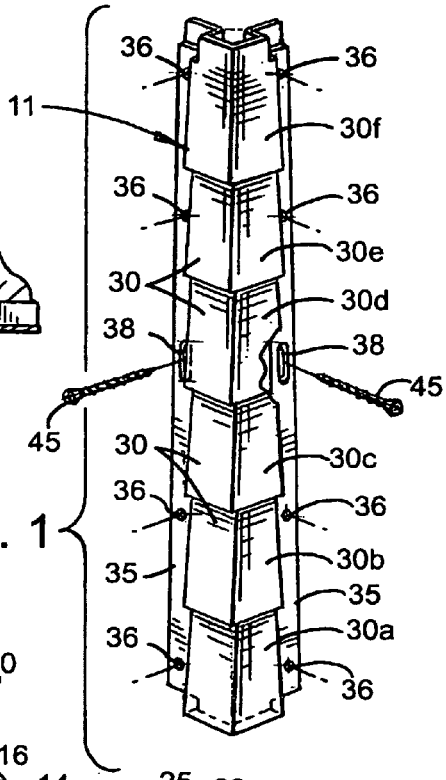
FIG. 1 is a perspective of a synthetic wall covering corner molding in accordance with the invention.
Figure 2:
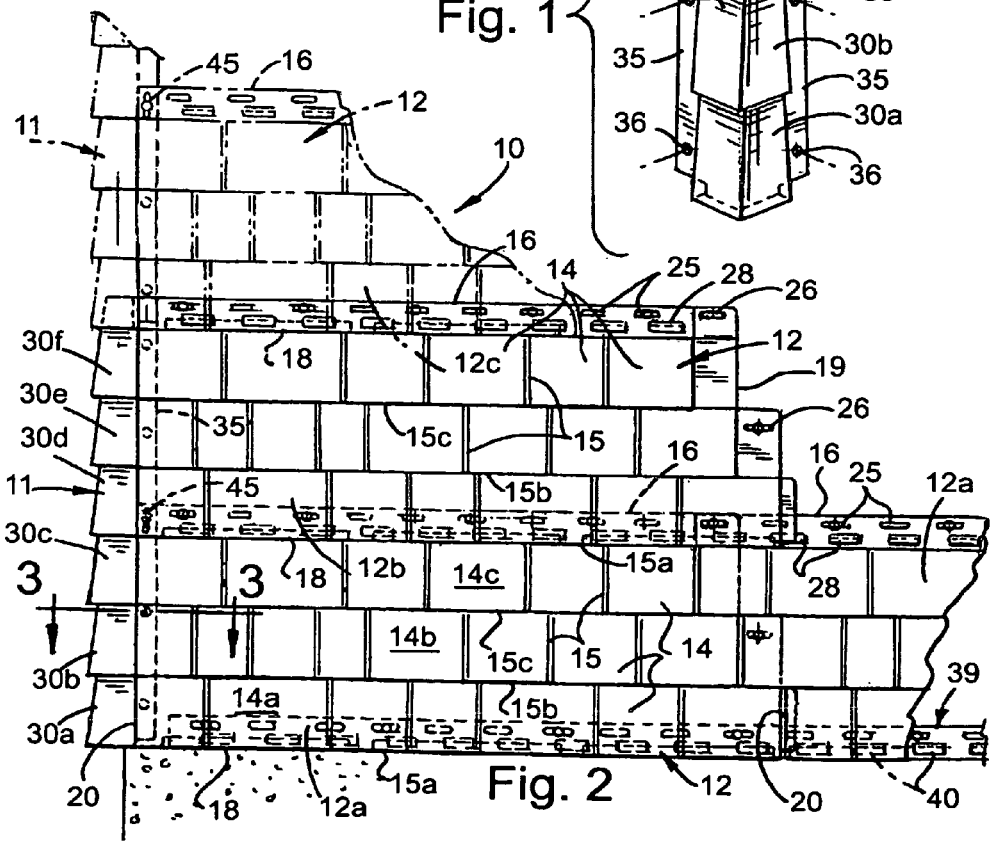
FIG. 2 is a plan view of a wall covering with corner moldings in accordance with the invention.
Figure 9:
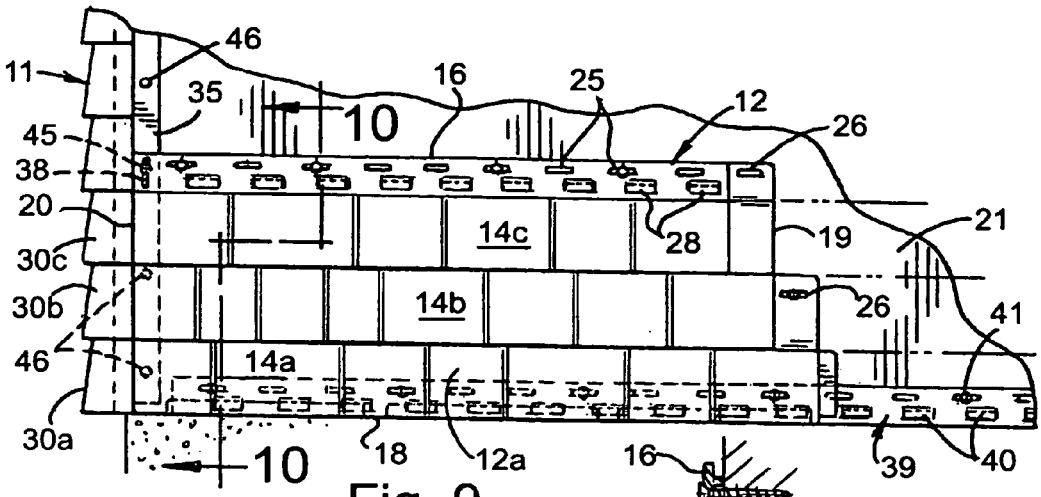

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE PREFERRED EMBODIMENT

Referring now more particularly to the drawings, there is shown an illustrative wall covering 10 mounted about a 90° corner of a roof or sidewalls of a building structure. The wall covering 10 comprises a plurality of corner moldings 11 mounted in vertically stacked relation to each other and a plurality of panels 12 mounted laterally to the sides the corner molding 11.

The panels 12 in this case are of a type shown in application Ser. No. 10/144,284 filed May 10, 2002, assigned to the same assignee as the present application, the disclosure of which is incorporated herein by reference. The panels 12, which preferably are molded out of relatively thin rigid plastic material, each are formed with simulated building elements. In this instance, the panels 12 are formed with simulated cedar shake 14 of irregular width which are disposed in a plurality of parallel rows 14*a*, 14*b*, 14*c*, with adjacent shake 14 in each row being separated by a small gap 15. The illustrated simulated shake pattern is of a type known in the industry as "perfection" shake, wherein the lower edges 15*a*, 15*b*, 15*c* of the rows 14*a*, 14*b*, 14*c* are in substantially straight line, and except for their width, the individual shake elements are substantially similar in appearance. It will be understood that the panels 12 could be formed with other forms of simulated shake shingles, or other types of building materials, such as tile, brick and the like.

Each illustrated panel 12 has an upper horizontal marginal edge region 16 having a substantially uniform width extending across the top of the panel immediately above the top row 14*a* of shake 14, a lower marginal edge region 18 which defines a lower peripheral edge of the panel 12, a side marginal edge region 19 located to the right-hand side of the last simulated shake 14 in each row 14*a*, 14*b*, 14*c*, and a marginal edge region 20 on the opposite side of the panel 12 which defines a left-side peripheral edge immediately adjacent the first simulated shake of each row 14*a*, 14*b*, 14*c*. The panels 12 are mounted on right angle support surfaces 21 of the building wall or roof structure, in horizontal courses 12*a*, 12*b*, 12*c* with the right-side marginal edge region 19 in underlying relation to the left-side marginal edge region 20 of the panel immediately to the right thereof and with the lower marginal edge region 18 of the panels 12 in each course overlying the upper marginal edge region 16 of the panel in the course immediately below. To enable side-by-side installation of the panels 12 with the junctures between panels less noticeable to the eye, the rows 14*a*, 14*b*, 14*c* of shake 14 of each panel 12 extend in lateral offset relation to each other so as to define stepped left and right-hand sides of the panel. As is known in the art, the stepped end of a panel 12 mounted adjacent a corner molding 11 is cut square with the corner molding 12 at the time of installation.

Figure 10:
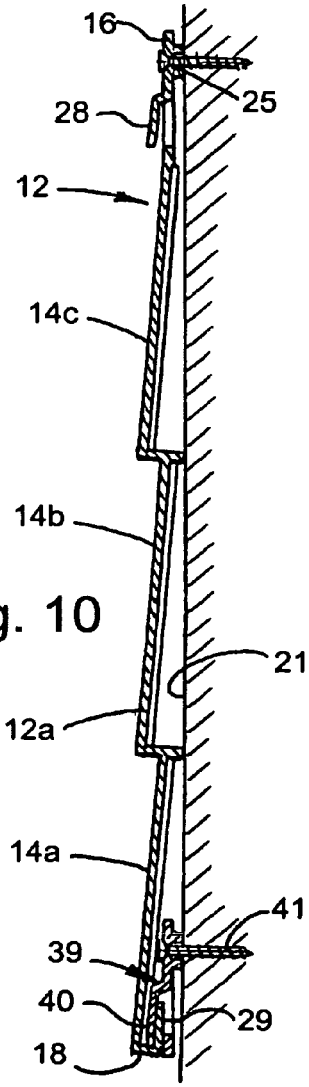
FIG. 10 is an enlarged vertical section of a mounted panel, taken in the plane of line 10—10 in FIG. 9.

For securing the panels 12 to a support surface 21, the upper marginal edge region 16 of each panel 12 is formed with a row of elongated laterally spaced fastener apertures 25 and the right-side marginal edge region 19 is formed with a pair fastener apertures 26. It will be understood by one skilled in the art that such panels 12 typically are nailed or screwed to the support surface 21, and the term "fastener aperture" is intended to include apertures in the panel designed to receive either a fastening nail or screw. For interlocking overlapping upper and lower marginal edge regions 16, 18 of the panels 12 of adjacent courses 12*a* 12*b*, 12*c*, the upper marginal edge region 16 of each panel 12 is formed with a plurality of downwardly directed interlock flanges 28 which are adapted to engage an upwardly directed interlock lip 29 (FIG. 10) of the lower marginal edge region 18 of the overlying panel. For interlocking the side marginal edge regions 19, 20, the left-side marginal edge region 20 also may be provided with appropriate interlocking means for engagement with an underlying right-side marginal edge region 19 of the previously mounted panel, such as disclosed in the afore-referenced application Ser. No. 10/144,284.

The corner moldings 11 are formed with a plurality of tiers 30*a*–30*f* of simulated building elements 30, again "perfection shake," with the building elements of each tier 30*a*–30*f* in this case being formed with a right-angled juncture to each other. The building elements 30 of each tier has an outer surface extending in a downward and outward tapered fashion, similar to the simulated shake of the panels 12. The illustrated corner moldings 11 have an elongated height twice the height of the panels 12 and are formed with six tiers 30*a*–30*f* of right-angle junctured simulated building elements 20. Hence, two panels 12 are mountable adjacent each side of a corner molding 11 with the three rows or tiers 14*a*–14*c* of building elements of each panel 12 being disposed adjacent a respective three tiers 30*a*–30*c* and 30*d*–30*f* of building elements 30 of the corner molding 11. To facilitate securement of the corner molding 11 on the support surfaces 21 that define a corner of the roof or wall structure, the corner moldings 11 each have mounting flanges 35 extending outwardly in recessed relation to the tiers 30*a*–30*f* of building elements 30 in perpendicular planes for positioning on the right angle support surfaces 21. The mounting flanges 35 each are formed with vertically spaced nail or screw-receiving apertures 36, 38 (i.e., fastener apertures).

The panels 12 preferably are mounted beginning with the left-hand panel of the lowermost course 12*a* to be installed on the wall or roof, with a square cut end of the panel 12 in overlying relation to the mounting flange 35 of the corner molding 11. To facilitate mounting of the first course 12*a* of panels 12, a starter strip 39 of a known type is mounted along the lower perimeter of the support surface 21 The illustrated starter strip 39 includes downwardly directed locking flanges 40, similar to the locking flanges 28 of the upper marginal edge region 16 of the panels 11, for engaging the interlock lips 29 of the lower marginal edge regions 18 of the first course 12*a* of panels 12.

When starting the installation of a course of panels from a corner, as indicated above, typically the installer must hold the corner molding 11 in one hand and the panel 12 in the other hand, arrange the panel 12 on the starter strip 39 or on the upper marginal edge region 16 of a panel 12 of a previously mounted course, and align the rows 14*a*–14*c* of building elements of the panel 12 with the tiers 30*a*–30*c* of building elements 30 of the corner molding 10. He must them remove the panel 12, while maintaining the corner molding 10 in its located position, secure mounting fasteners to the corner molding 11, then reposition the panel 12, and check to verify proper alignment. If alignment of the adjacent building elements 14, 30 is not precise, the corner molding 11 must be removed and reinstalled. As indicated, this can be a tedious and time consuming procedure.

In accordance with the invention, mounting flanges of the corner moldings include (1) one form of fastener aperture which permit preliminary installation and adjustment of the corner molding on the support surface for precise positioning of the building elements of the corner molding with the building elements of a panel to be installed adjacent thereto and (2) a second form of fastener aperture, different from the first form, which precisely secures and maintain the corner molding in mounted position. More particularly, each mounting flange of the corner moldings includes (1) at least one elongated fastener aperture aligned parallel to the height or length of the corner molding designed to permit relative vertical positioning of the corner molding with respect to a fastening screw or nail preliminarily securing the corner molding on a support surface, and (2) at least one fastener aperture of circular or other design for precisely locating and maintaining the corner molding in fixed mounted relation to the support surface. To this end, in the illustrated embodiment, the corner molding mounting flanges 35 each included a single elongated fastener slot 38 oriented parallel to the elongated dimension of the corner molding designed to receive a mounting nail or screw while permitting relative longitudinal movement of the corner molding 12 and a plurality of circular fastener apertures 36 designed to snuggly receive and secure the mounting flanges 35 in fixed position on the support surface 12. The elongated fastener slots 38 in this case are located approximately in the middle of the respective mounting flange 35 and two circular fastener apertures 36, which neither permits longitudinal or lateral play, are formed in the respective mounting flanges 35 at equally spaced intervals above and below the central elongated slots 38 As will become apparent to a person skilled in the art, alternatively the mounting flanges 35 could be formed with a plurality of elongated fastener slots and a single circular or non-elongated fastener aperture 36, or alternatively, a plurality of elongated fastener slots 38 and a plurality of circular or non-elongated fastener apertures 36. The utility of such combination of elongated and non-elongated corner molding mounting apertures 38, 36 will become apparent in connection with the following description of the installation procedure for the wall covering 10, as depicted in FIGS. 4–9.

As a first step in the installation procedure, the starter strip 39 is screwed or nailed at 41 to the lower perimeter of the wall or roof surface 21 to be covered and a first corner molding 11 is positioned on the corner with its lower end adjacent the end of the starter strip 39, as depicted in FIG. 4. The corner molding 11 may be preliminarily secured in place on the support surfaces 21 by two screws 45 which extend through the elongated slots 38 of the mounting flanges 35, as depicted in FIG. 5. The screws 45 may be screwed in sufficiently to retain the corner molding 11 in position on the support surfaces 21, but permit manual adjustable movement of the corner molding 11 along the corner as permitted by the slots 38. With the corner molding 11 preliminarily mounted on the support surfaces 21 in such manner, the lower marginal edge region 18 of the first panel 12 in the course 12*a*, may be positioned onto the starter strip 39 and a pre-cut left-hand side 20 thereof positioned in overlapping relation to the mounting flanges of the corner molding 11. With the panel 12 positioned in place, the installer can then observe any misalignment between the tiers 14*a*–14*c* of building elements 14 of the panel 12 and the tiers 30*a*–30*c* of the building elements 30 of the corner molding 11, as depicted by the misalignment distance X in FIG. 6. Upon observing the misalignment, the corner molding 11 may be adjusted downwardly, as depicted in FIG. 7, without removal of the preliminary mounting screws 45, to effect precise alignment of the building elements of the corner molding 11 and panel 12. Thereupon, the panel 12 may be removed, while the corner molding 11 is maintained in place by the slot screws 45, the screws 45 can be tightened, and the mounting flanges 35 can be secured to the support surface 21 by additional screws 46 passing through the circular, non-elongated fastener apertures 36, which maintain the panel 12 in precise mounted position on the support surface 21 without play between the fastener apertures 36, 38 and the screws 45, 46.

With the corner molding 11 fixedly mounted on the corner in such manner, the first panel 12 may be repositioned onto the starter strip 39 with the left-hand end in overlying relation to the corner molding mounting flanges 35 and can be secured by nails or screws through the fastener apertures 25, 26. The remaining panels 12 in the first course 12*a* then are successively installed along the support surface 21, each having a lower marginal edge region engaging the starter strip and a left-hand marginal edge region overlying the right-hand marginal edge region of the previously mounted adjacent panel.

If the course 12*a* is to terminate at a corner, a corner molding mounting procedure, similar to that described at the left-hand end is employed at the termination end of the course, i.e. the right-hand side. A corner molding 11 again is positioned in its approximate mounted position on the corner and preliminarily secured thereto by mounting screws 45 in the elongated adjustment fastening apertures 38. A square cut end of the final panel 12 in the course is thereupon positioned on the starting strip and adjacent the corner molding 11, any misalignment of the building elements of the panel 12 and corner molding 11 is observed, the corner molding 11 is adjusted with respect to the preliminary mounting screws 45, the panel 12 is removed, and the corner molding 11 is fixedly secured to the support surface 21 by screws 46 through the circular apertures 36. The final panel in the course is then mounted and secured to the support surface to complete the first course.

In the illustrated embodiment since the second course 12*b* of panels 12 will abut against the previously installed first corner molding 11, no further adjustment procedure is necessary. Mounting of the panels 12 of the second course 12*b* in interlocking relation with the underlying panels will automatically establish the proper assembled position of the panels of the second course 12*b* in relation to the corner molding 11. Following completion of the second course, the start of the third course 12*c* will require preliminary mounting, adjustment, and final mounting of the next corner molding 11, consistent with the procedure described previously.

From the foregoing, it can be seen that the corner moldings of the present invention enable simpler, more efficient, and more precise mounting of the corner moldings and adjacent panels than heretofore possible. The elongated preliminary fastener slots permit the corner molding to be adjustably positioned and retained on the corner during installation, while freeing the installer to more easily handle the adjacent panel. The corner molding design eliminates the prior tedious trial and error mounting procedure for such corner moldings and adjacent panel. The circular, non-elongated fastener apertures, furthermore, permit precise retention of the corner molding in their properly aligned mounted position.

What is claimed is:

1. A method of installing a wall covering on angled wall surfaces that defines a corner using (1) elongated corner moldings formed with vertically arranged tiers of simulated building elements with mounting flanges on opposite elongated sides thereof each formed with at least one fastener-receiving aperture of a first form and at least one fastener-receiving aperture of a second form different from the first form and (2) and a plurality of panels each formed with a plurality of horizontal rows of simulated building elements comprising the steps of:

positioning a corner molding on the corner with the mounting flanges on the angled wall surfaces, preliminarily securing the corner molding on the corner with a first fastener extending into the wall surface through said at least one aperture of the first form, positioning a first one of said panels on one of said wall surfaces at an intended installed position adjacent the preliminarily secured corner molding, adjustably positioning the corner molding on the corner relative to the first fastener and said positioned first panel to an adjusted position in which the tiers of simulated building elements of the corner molding are aligned with the simulated building elements of the positioned first panel, removing the positioned first panel, securing the corner molding in the position to which said corner molding was adjustably positioned with at least one second fastener through said at least one fastener aperture of said second form, repositioning said first panel on the wall surface in the intended installed position of said first panel, and securing the repositioned first panel to said one wall surface.

2. The method of claim 1 including cutting an end of said first panel square with respect to the corner molding prior to positioning the first panel into the intended installed position of the first panel, and mounting additional panels in side-by-side partially overlapping relation to each other to complete a horizontal course of panels following securing of said first panel to said one wall surface in said installed position.

3. The method of claim 1 including positioning said first panel into the intended installed position of the first panel by engaging a lower marginal edge region of the panel with a starter strip mounted along a lower perimeter of the one wall surface.

4. The method of claim 2 including positioning said first panel into the intended installed position of the first panel by engaging a lower marginal edge region of the panel with the upper marginal edge region of a panel of a previously installed course of said panels.

5. The method of claim 4 including mounting said additional panels with the left-hand marginal edge region in interlocking engagement with an underlying right-hand marginal edge region of a previously installed panel.

* * * * *